US009021998B2

(12) United States Patent
Moetakef et al.

(10) Patent No.: US 9,021,998 B2
(45) Date of Patent: May 5, 2015

(54) VARIABLE CAM TIMING SYSTEM AND METHOD

(71) Applicant: Ford Global Technologies, LLC, Dearborn, MI (US)

(72) Inventors: Mohammad Ali Moetakef, West Bloomfield, MI (US); Jamie Charles Hanshaw, South Lyon, MI (US); Wesley Kridner, Canton, MI (US); Georg Festag, Dearborn, MI (US); Steve Poe, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 149 days.

(21) Appl. No.: 13/674,821

(22) Filed: Nov. 12, 2012

(65) Prior Publication Data

US 2014/0130754 A1 May 15, 2014

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34456* (2013.01); *F01L 2001/34469* (2013.01)

(58) Field of Classification Search
CPC ..... F01L 1/344; F01L 1/3442; F01L 2001/34456; F01L 2001/34469
USPC ..... 123/90.17, 90.15; 464/160
See application file for complete search history.

(56) References Cited

U.S. PATENT DOCUMENTS

| | | | | |
|---|---|---|---|---|
| 5,099,805 | A | 3/1992 | Ingalls | |
| 5,823,152 | A * | 10/1998 | Ushida | 123/90.17 |
| 6,311,655 | B1 | 11/2001 | Simpson et al. | |
| 6,668,778 | B1 | 12/2003 | Smith | |
| 7,240,651 | B1 | 7/2007 | Hanshaw | |
| 7,703,424 | B2 | 4/2010 | Nakamura et al. | |
| 7,779,796 | B2 * | 8/2010 | Nakamura | 123/90.15 |
| 2007/0204816 | A1 | 9/2007 | Russell et al. | |

* cited by examiner

*Primary Examiner* — Ching Chang
(74) *Attorney, Agent, or Firm* — Julia Voutyras; Alleman Hall McCoy Russell & Tuttle LLP

(57) ABSTRACT

A phase control apparatus in a variable cam timing (VCT) system of an engine is described herein. The phase control apparatus includes a locking pin coupled to a vane, the locking pin extending into a locking pin recess in a cover plate in a locked configuration, the locking pin and locking pin recess having a backlash and a housing at least partially enclosing the vane and spaced away from the vane forming a gap in the locked configuration.

15 Claims, 7 Drawing Sheets

VARIABLE CAM TIMING SYSTEM AND METHOD

FIELD

The present disclosure relates to a variable cam timing system including a locking mechanism.

BACKGROUND AND SUMMARY

Variable cam timing (VCT) is used in engines to advance or retard intake and/or exhaust valve timing. Consequently, intake and/or exhaust valve timing may be adjusted based on engine operating conditions to increase combustion efficiency and decrease emissions, if desired. Additionally, engine power output may be increased across a wider range of engine operating conditions.

Locking mechanisms in VCT systems have been developed to lock the VCT system in a desired base configuration when there is insufficient oil pressure to operate the VCT system. For example, U.S. Pat. No. 5,823,152 discloses an angular phase control apparatus for an engine including a tapered locking member configured to mate with an engaging bore to lock the apparatus in a desired angular position.

The Inventors have recognized several drawbacks with the valve timing control apparatus disclosed in U.S. Pat. No. 5,823,152. Manufacturing the locking device disclosed in U.S. Pat. No. 5,823,152 may be costly due to the small tolerances of the tapered locking member and the tapered bore. Additionally, the tapered locking member may become disengaged, due to air pressure, for example. Consequently, the partially disengaged member may move back and forth (e.g., rattle) in an engaging bore receiving the locking member. As a result, the noise, vibration, and harshness (NVH) in the vehicle may be increased, thereby decreasing customer satisfaction and component longevity. Furthermore, the locking member disclosed in U.S. Pat. No. 5,823,152 may become stuck in the engaging bore due to the tapered matting. As a result, phase control functionality may be delayed or inhibited, thereby decreasing combustion efficiency and increasing emissions.

The inventors herein have recognized the above issues and developed a phase control apparatus in a VCT system of an engine is described herein. The phase control apparatus includes a locking pin coupled to a vane, the locking pin extending into a locking pin recess in a cover plate in a locked configuration, the locking pin and locking pin recess having backlash and a housing at least partially enclosing the vane and spaced away from the vane forming a gap in the locked configuration.

The phase control apparatus includes a locking pin coupled to a vane, the locking pin extending into a locking pin recess in a cover plate in a locked configuration, the locking pin and locking pin recess having a backlash and a housing at least partially enclosing the vane and spaced away from the vane forming a gap in the locked configuration.

When the housing is spaced away from the vane in a locked configuration the vibration caused by the contact between the vane and the housing is substantially reduced (e.g., eliminated). In this way, NVH in the engine is reduced, thereby increasing customer satisfaction and component longevity when compared to VCT systems having the housing in direct contact with a vane in a locked configuration.

In one example, the backlash may be less than the gap between the housing and the vane. In this way, the movement of the locking pin in the locking pin recess does not cause the vane to contact the housing in a locked configuration. As a result, NVH is reduced.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

BRIEF DESCRIPTION OF THE DRAWINGS

FIGS. 3-9 are drawn approximately to scale, however other relative dimensions may be used if desired.

DETAILED DESCRIPTION

A locking mechanism in a variable cam timing (VCT) system is disclosed herein. The locking mechanism includes a locking pin and locking pin recess having backlash. The locking mechanism also includes a vane and housing, the relative position of the vane and the housing may be adjusted to alter cam timing. In a locked configuration when the locking pin is mated with the locking pin recess, the vane is circumferentially spaced away from the housing in a hydraulic chamber. When the housing is spaced away from the vane, the likelihood of the vane contacting or striking the housing during locking is reduced (e.g., eliminated). Consequently, noise, vibration, and harshness (NVH) in the VCT system is reduced which increases customer satisfaction and decreases component wear. This spacing also enables the tolerances of the locking pin and locking pin recess to be increased if desired, thereby decreasing manufacturing costs.

Figure 1:
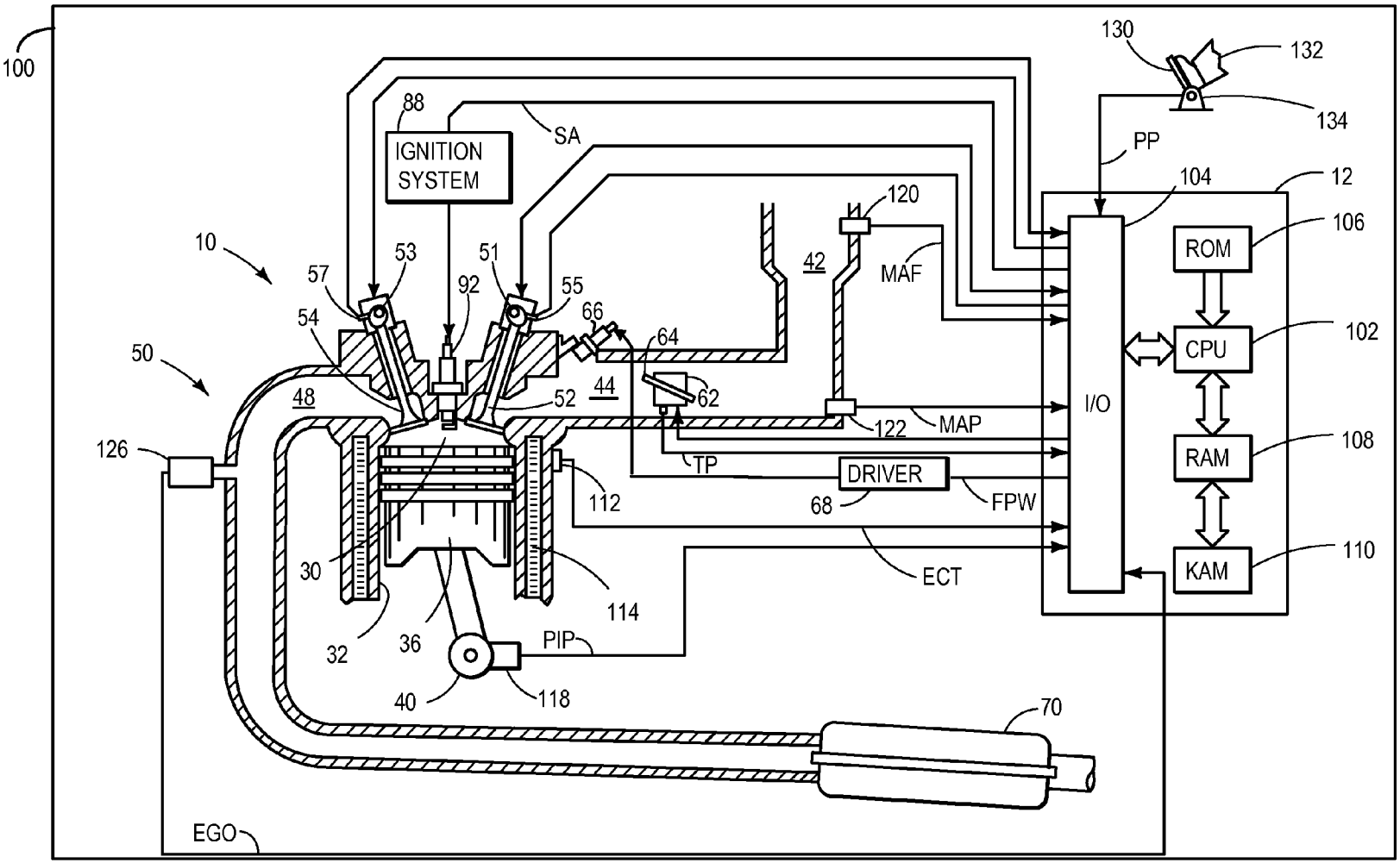
FIG. 1 shows a schematic depiction of an engine.
Figure 2:
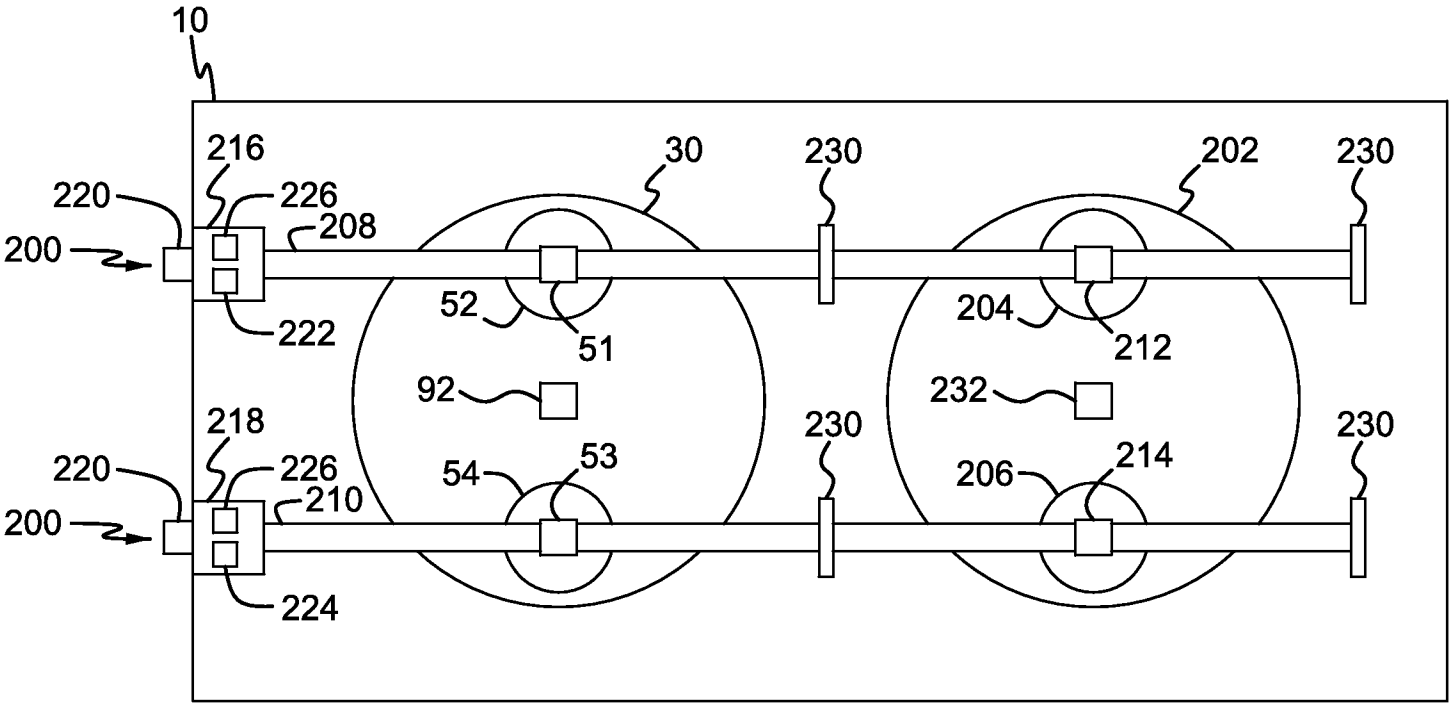
FIG. 2 shows another schematic depiction of the engine shown in FIG. 1 including a variable cam timing (VCT) system.

FIGS. 1 and 2 show schematic depictions of an internal combustion engine. FIGS. 3-9 show various views of an example phase control apparatus in a VCT system of the engine shown in FIGS. 1 and 2. FIG. 10 shows a method for operation of a VCT system.

FIG. 1 is a schematic diagram showing one cylinder of multi-cylinder engine 10, which may be included in a propulsion system of a vehicle 100 in which an exhaust gas sensor 126 (e.g., air-fuel sensor) may be utilized to determine an air fuel ratio of exhaust gas produce by engine 10. The air fuel ratio (along with other operating parameters) may be used for feedback control of engine 10 in various modes of operation. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Cylinder (i.e., combustion chamber) 30 of engine 10 may include combustion chamber walls 32 with piston 36 positioned therein.

Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10. The crankshaft 40 may also be coupled to a VCT system described in greater detail herein.

Cylinders 30 may receive intake air from intake manifold 44 via intake passage 42 and may exhaust combustion gases via exhaust passage 48. Intake manifold 44 and exhaust passage 48 can selectively communicate with cylinder 30 via respective intake valve 52 and exhaust valve 54. In some examples, cylinder 30 may include two or more intake valves and/or two or more exhaust valves. A throttle 62 including a throttle plate 64 is positioned in the intake passage 42. The throttle is configured to adjust the amount of airflow flowing to the cylinder 30.

In this example, intake valve 52 and exhaust valves 54 may be actuated via an intake cam 51 and an exhaust cam 53. In some examples, the engine 10 may include a VCT system configured to adjust (e.g., advance or retard) cam timing. The position of intake valve 52 and exhaust valve 54 may be determined by position sensors 55 and 57, respectively.

Fuel injector 66 is shown arranged in intake manifold 44 in a configuration that provides what is known as port injection of fuel into the intake port upstream of cylinder 30. Fuel injector 66 may inject fuel in proportion to the pulse width of signal FPW received from controller 12 via electronic driver 68. In some examples, cylinder 30 may alternatively or additionally include a fuel injector coupled directly to cylinder 30 for injecting fuel directly therein, in a manner known as direct injection.

Ignition system 88 can provide an ignition spark to cylinder 30 via spark plug 92 in response to spark advance signal SA from controller 12, under select operating modes. Though spark ignition components are shown, in some examples, cylinder 30 or one or more other combustion chambers of engine 10 may be operated in a compression ignition mode, with or without an ignition spark.

Exhaust gas sensor 126 is shown coupled to exhaust passage 48 of exhaust system 50 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. In some examples, exhaust gas sensor 126 may be a first one of a plurality of exhaust gas sensors positioned in the exhaust system. For example, additional exhaust gas sensors may be positioned downstream of emission control device 70.

Emission control device 70 is shown arranged along exhaust passage 48 downstream of exhaust gas sensor 126. Emission control device 70 may be a three way catalyst (TWC), NOx trap, various other emission control devices, or combinations thereof. In some examples, emission control device 70 may be a first one of a plurality of emission control devices positioned in the exhaust system. In some examples, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory 106 (e.g., memory chip) in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

During operation, the cylinder 30 in the engine 10 typically undergoes a four stroke cycle: the cycle includes the intake stroke, compression stroke, expansion stroke, and exhaust stroke. In a multi-cylinder engine the four stroke cycle may be carried out in additional combustion chambers. During the intake stroke, generally, exhaust valve 54 closes and intake valve 52 opens. Air is introduced into cylinder 30 via an intake manifold, for example, and piston 36 moves to the bottom of the combustion chamber so as to increase the volume within cylinder 30. The position at which piston 36 is near the bottom of the combustion chamber and at the end of its stroke (e.g. when cylinder 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within cylinder 30. The point at which piston 36 is at the end of its stroke and closest to the cylinder head (e.g. when cylinder 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition devices such as a spark plug 92, resulting in combustion. Additionally or alternatively compression may be used to ignite the air/fuel mixture. During the expansion stroke, the expanding gases push piston 36 back to BDC. A crankshaft may convert piston movement into a rotational torque of the rotary shaft. Finally, during the exhaust stroke, exhaust valve 54 opens to release the combusted air-fuel mixture to an exhaust manifold and the piston returns to TDC. Note that the above is described merely as an example, and that intake and exhaust valve opening and/or closing timings may vary, such as to provide positive or negative valve overlap, late intake valve closing, or various other examples. The valve timing may be altered by a VCT system discussed in greater detail herein. Additionally or alternatively compression ignition may be implemented in the cylinder 30.

FIG. 2 shows an example VCT system 200 included in the engine 10, also shown in FIG. 1. The VCT system 200 shown in FIG. 2 is configured to adjust the timing of both the intake and exhaust cams in the engine 10. However, in other examples, the VCT system may only be configured to adjust the timing of the intake cams or the timing of the exhaust cams.

As shown the engine 10 includes the first cylinder 30, also shown in FIG. 1, and a second cylinder 202. However, it will be appreciated that the number of cylinders in the engine may be varied in other examples. For instance, the engine 10 may include four cylinders, in one example.

The cylinders are arranged in an inline configuration. That is to say that a flat plane extends through the centerline of each cylinder. However, other cylinder positions have been contemplated. The intake valve 52 and the exhaust valve 54 of the first cylinder 30 are shown. It will be appreciated that the valve may be positioned, respectively, in an intake port and an exhaust port. Likewise, an intake valve 204 and an exhaust valve 206 are coupled to the second cylinder 202. The intake valve 204 and the exhaust valve 206 are configured to open during combustion operation. Specifically, the intake valve 204 may enable fluidic communication between the second cylinder 202 and the intake manifold 44, shown in FIG. 1, in an open configuration and inhibit fluidic communication between the second cylinder 202 and the intake manifold 44, shown in FIG. 1, in a closed configuration. Additionally, the exhaust valve 206 may enable fluidic communication between the second cylinder 202 and the exhaust passage 48, shown in FIG. 1, in an open configuration and inhibit fluidic communication between the second cylinder 202 and the exhaust passage 48, shown in FIG. 1, in a closed configuration.

The VCT system 200 may include an intake camshaft 208 and/or an exhaust camshaft 210. The intake camshaft 208 may include intake cam 51 and intake cam 212 coupled thereto. The intake cams 51 and 212 are configured to cyclically actuate the intake valves during combustion operation. Likewise, the exhaust camshaft 210 may include exhaust cam 53 and exhaust cam 53 coupled thereto. The exhaust cams 53 and 214 are configured to cyclically actuate the exhaust valves during combustion operation. It will be appreciated that the cirfumerential position of the intake and/or exhaust cams may vary to enable actuation of the intake and exhaust valves at different time intervals.

The VCT system 200 further includes a first phase control apparatus 216 (e.g., intake phase control apparatus) and a second phase control apparatus 218 (e.g., exhaust phase control apparatus). As shown, the first phase control apparatus 216 is coupled to the intake camshaft 208. Additionally, the second phase control apparatus 218 is coupled to the exhaust camshaft 210. The first and second phase control apparatuses may be configured to adjust the phase between the crankshaft 40, shown in FIG. 1, and the respective camshaft.

The VCT system 200 may further include mechanical linkage 220 coupling the crankshaft 40, shown in FIG. 1, to the camshafts (208 and 210). The first phase control apparatus 216 may be identical to the second phase control apparatus 218. An example phase control apparatus 300 is shown FIGS. 3-9 and described in greater detail herein. The phase control apparatus 300 shown in FIGS. 3-9 may be one of the first phase control apparatus 216 or the second phase control apparatus 218, shown in FIG. 2. However, in other examples the phase control apparatuses (216 and 218) may have dissimilar configurations.

The first phase control apparatus 216 may include a locking mechanism 222 generically depicted via a box. It will be appreciated that the locking mechanism may have a greater complexity which is discussed in greater detail herein. Likewise, the second phase control apparatus 218 may also include a locking mechanism 224. The locking mechanisms (222 and 224) may be identical, in one example. The locking mechanisms (222 and 224) may be constructed such that NVH are reduced in the VCT system. The locking mechanisms are discussed in greater detail herein with regard to FIGS. 3-9.

The controller 12 may be configured to control the VCT system 200 to advance or retard intake and/or exhaust valve timing. Specifically, the controller 12 may be electronically (e.g., wired and/or wirelessly) coupled to control valves 226 and 228 (e.g., solenoid valves) in the VCT system 200. The control valves 226 and 228 may be coupled to or integrated into their respective phase control apparatus. The control valves 226 may be configured to adjust the phase between the crankshaft 40, shown in FIG. 1, and a corresponding camshaft. Specifically, the control valves 226 and 228 may be oil control valves configured to hydraulically adjust the phase angle between the crankshaft 40, shown in FIG. 1 and a respective camshaft. Thus, the control valves 226 and 228 may receive oil from conduits in the engine. However, other suitable types of control valves have been contemplated.

Camshaft bearings 230 are coupled to the intake camshaft 208 and the exhaust camshaft 210. The camshaft bearings 230 are configured to support as well as enable rotation of the camshaft to which they are coupled. The spark plug 92 is also shown coupled to the first cylinder 30. A second spark plug 232 or other suitable ignition device may be coupled to the second cylinder 202.

FIGS. 3-9 show an example phase control apparatus 300. The phase control apparatus 300 shown in FIGS. 3-9 may be the first or the second phase control apparatus (216 and 218 respectively), shown in FIG. 2. Thus, the phase control apparatus 300 may be included in the VCT system 200, shown in FIG. 2.

Figure 3:
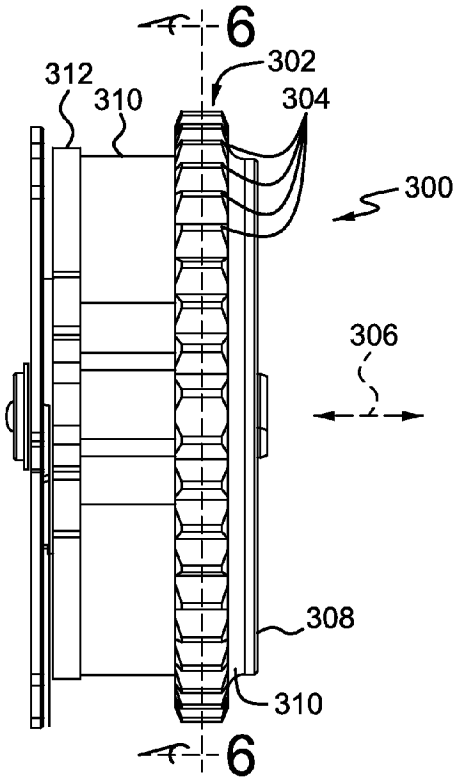

FIG. 3 shows a side view of the phase control apparatus 300. The phase control apparatus 300 includes a drive wheel 302. Specifically, in the depicted example the drive wheel 302 is a sprocket. Therefore, the drive wheel 302 includes teeth 304, in the depicted example. However, other types of drive wheels have been contemplated. A rotational axis 306 of the phase control apparatus 300 is also depicted. The drive wheel 302 may be coupled to the crankshaft 40 shown in FIG. 1. Mechanical linkage, such as a chain, sprockets, etc., may be used to couple (e.g., rotationally couple) the crankshaft 40, shown in FIG. 1, to the drive wheel 302. Therefore, it will be appreciated that the drive wheel 302 and the crankshaft 40 may rotate in the same phase.

Figure 6:
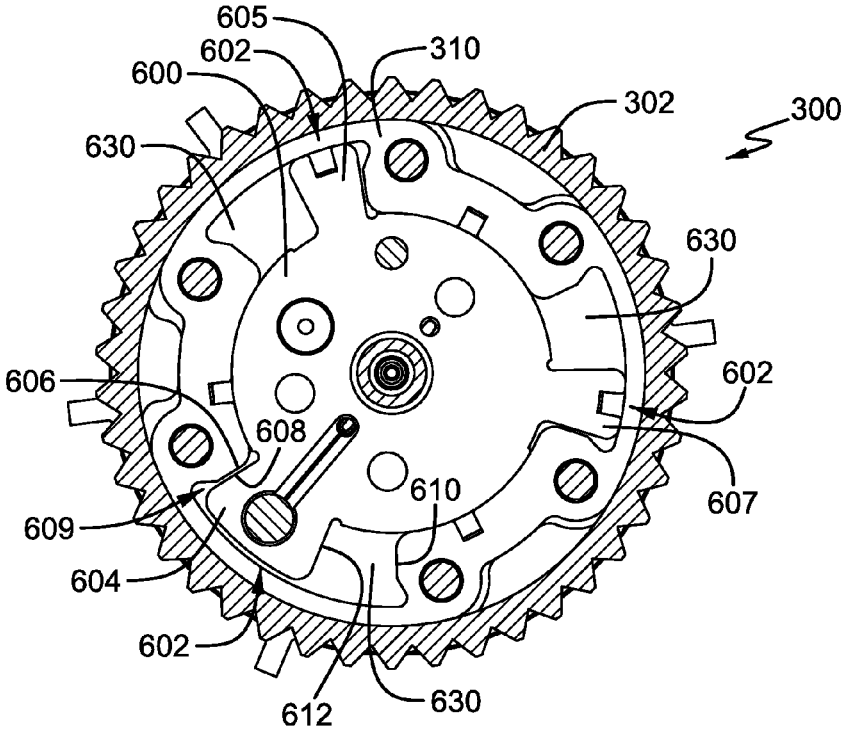

A vane rotor 600, shown in FIG. 6, included in the phase control apparatus 300 may be rotationally coupled to one of the camshafts (208 and 210), shown in FIG. 2. The relative angular position of the vane rotor 600 and the drive wheel 302 may be adjusted via the VCT system 200. In this way, the phase of the cams may be adjusted to alter valve timing. The cover plate 308 is coupled (e.g., fixedly coupled) to a housing 310 of the cam phasing apparatus 300. The housing 310 and/or cover plate 308 may be fixedly coupled to the drive wheel 302, in some examples. An inner plate 312 is also shown in FIG. 3. The cutting plane defining the cross-section shown in FIG. 6 is illustrated in FIG. 3.

Figure 4:
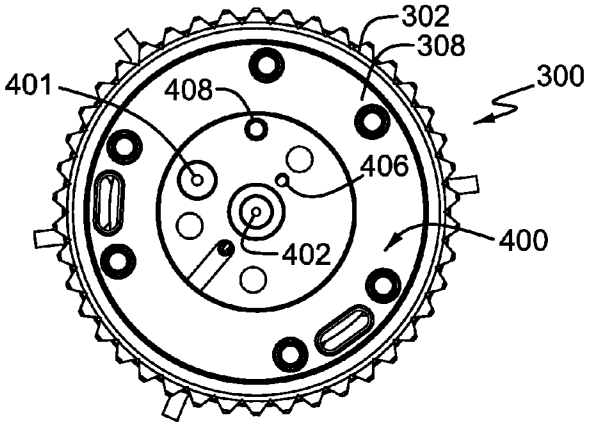
FIGS. 3-9 shows various views of an example phase control apparatus included in the VCT system shown in FIG. 2.

FIG. 4 shows a first end 400 of the phase control apparatus 300. The cover plate 308 and the drive wheel 302 are shown. The cover plate 308 and the drive wheel 302 may be fixedly coupled in some examples. Thus, the cover plate 308 and the drive wheel 302 rotate in the same phase during engine operation when combustion cycles are being performed in some examples.

An oil inlet 401 is also depicted in FIG. 4. Oil from the oil inlet may be directed to chambers adjacent to a vane rotor 600, shown in FIG. 6. Cam mounting openings (e.g., holes) 402 included in the phase control apparatus 300 are also depicted. The vane rotor 600 may attach to one of the camshafts (208 and 210), shown in FIG. 2.

Figure 8A:
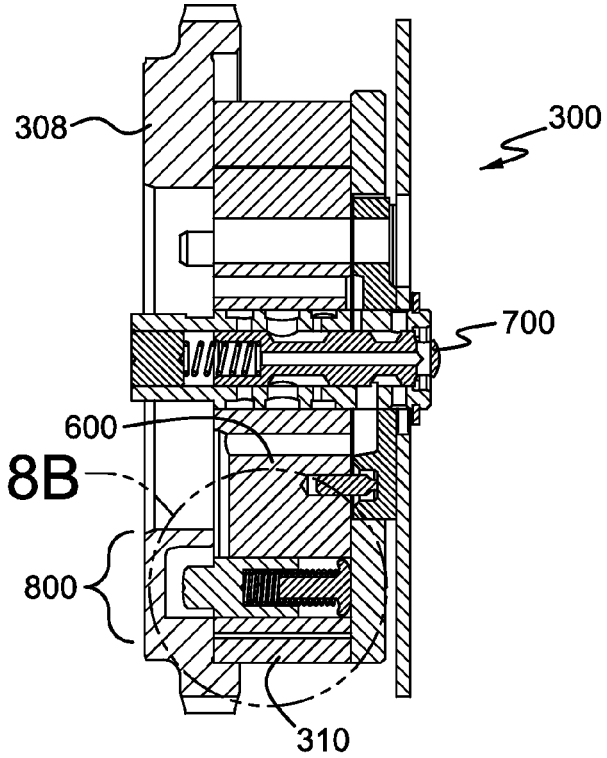
Figure 8B:
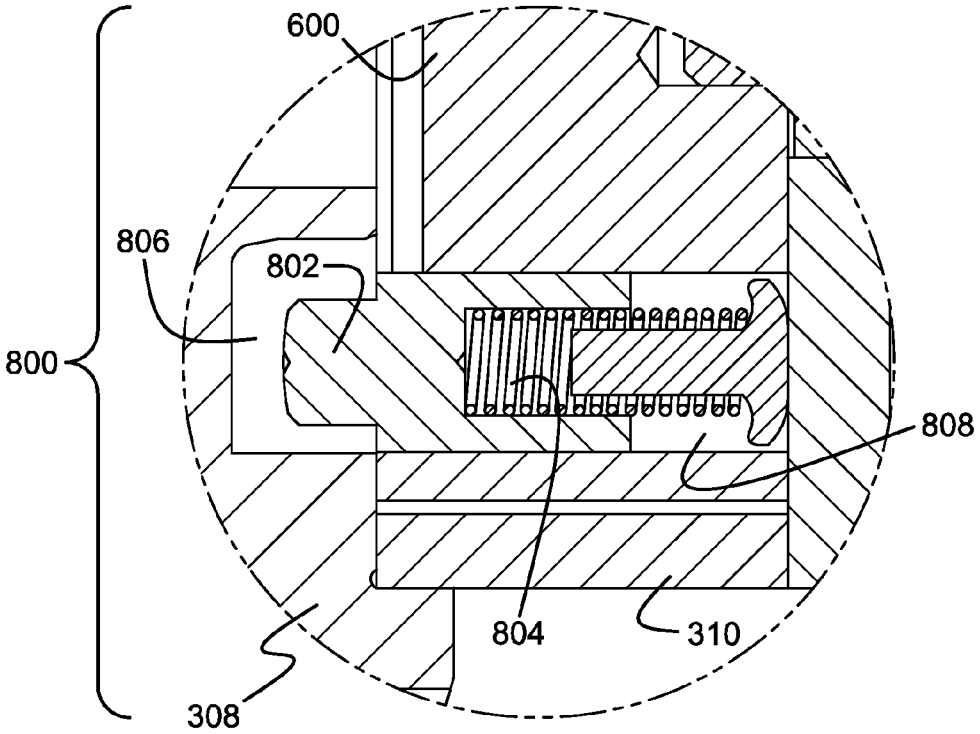
Figure 9:
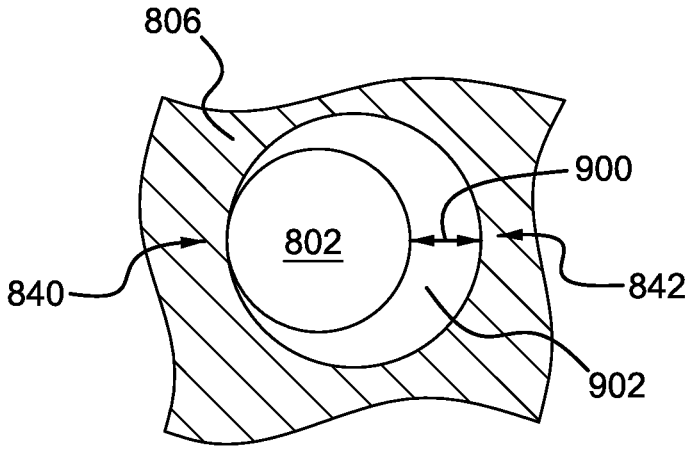
Figure 10:
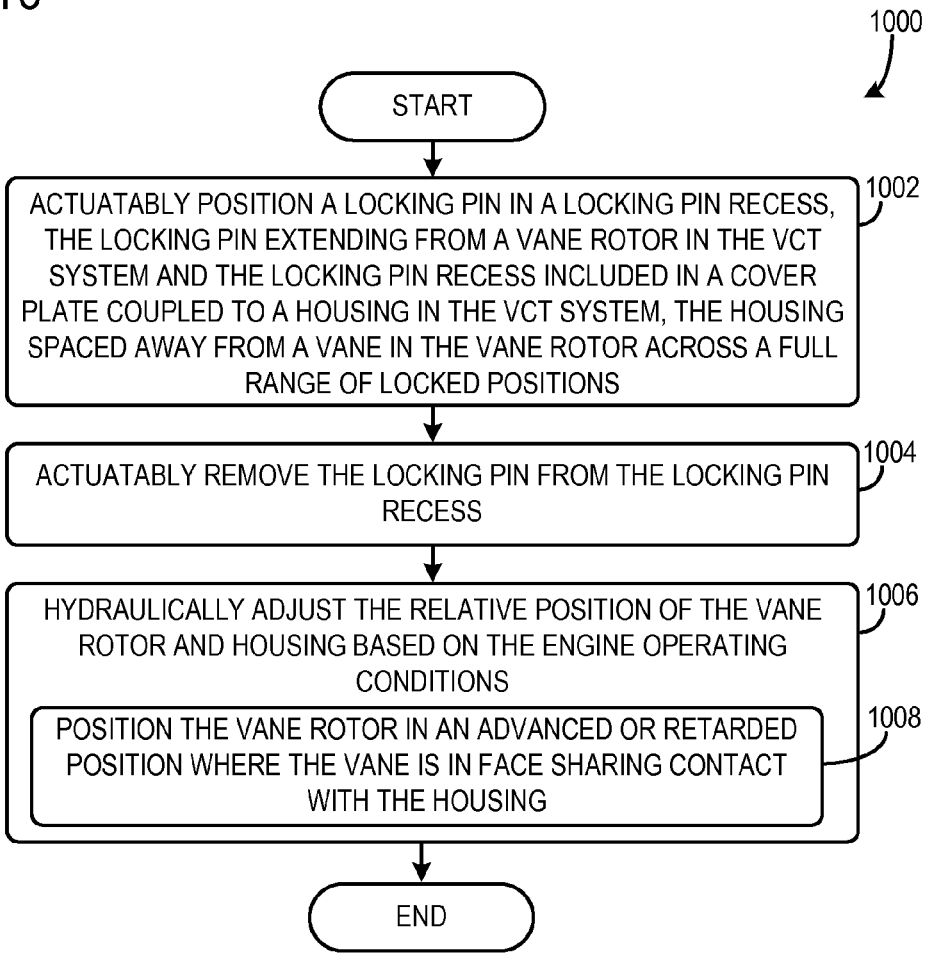
FIG. 10 shows a method for operation of a VCT system.

The phase control apparatus 300 shown in FIG. 4 further includes a supply inlet 406 for a locking pin 802, shown in FIGS. 8B and 9 and discussed in greater detail herein. The phase control apparatus 300 shown in FIG. 4 further includes a locating pin 408. However, it will be appreciated that one or more of the aforementioned components may be omitted from the phase control apparatus 300 in other examples.

Figure 5:
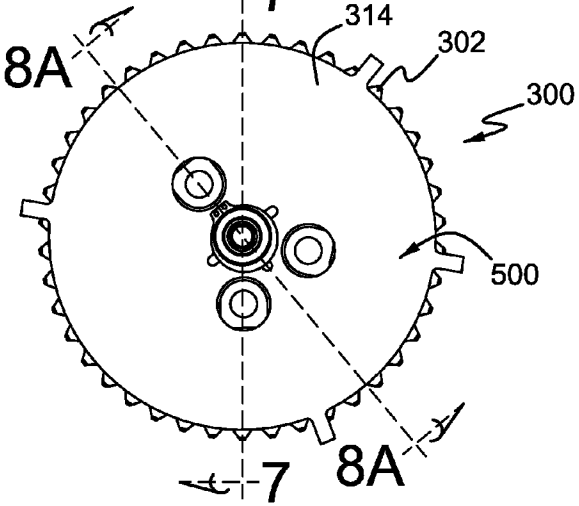
Figure 7:
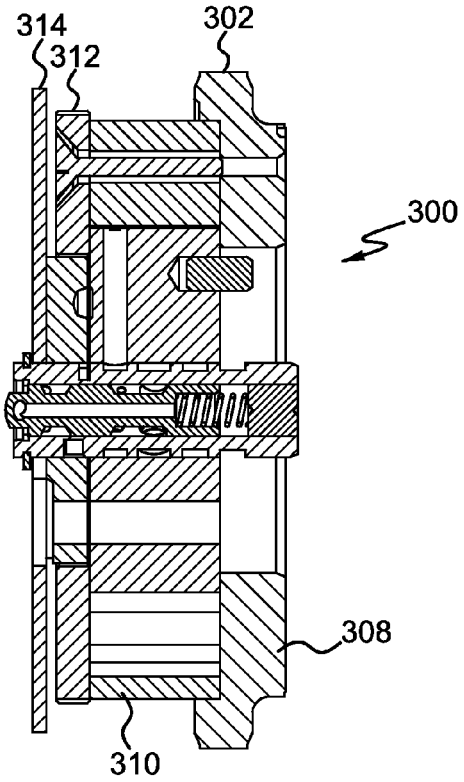

FIG. 5 shows a second end 500 of the phase control apparatus 300. The outer plate 314 and the drive wheel 302 are shown in FIG. 5. The cutting plane defining the cross-section shown in FIG. 7 is illustrated in FIG. 5 and the cutting plane defining the cross-section shown in FIG. 8A is also illustrated in FIG. 5.

FIG. 6 shows a cross-sectional view of the phase control apparatus 300. The housing 310 in the phase control apparatus 300 is shown in FIG. 6. The housing 310 is fixedly coupled to the drive wheel 302. Thus, the housing 310 and the drive wheel 302 rotate in the same phase.

A vane rotor 600 is also shown. The vane rotor 600 is fixedly coupled to a camshaft such as the intake camshaft 208 or the exhaust camshaft 210, shown in FIG. 2. The housing 310 at least partially encloses the vane rotor 600 and specifically the plurality of vanes 602 included in the vane rotor.

The vane rotor includes three vanes a first vane 604, a second vane 605, and a third vane 607, in the depicted example. However, an alternate number of vanes may be used in other examples. For instance, the vane rotor 600 may only include a single vane in one example. The vanes are included in hydraulic chambers 630.

The phase control apparatus 300 shown in FIG. 6 is in a locked configuration, discussed in greater detail herein. On the other hand, when the phase control apparatus 300 is in an unlocked configuration, the relative position of the vanes 602 and the housing 310 may be adjusted via a control valve such as one of the control valves 226, shown in FIG. 2. In this way, the cam timing may be adjusted based on engine operating conditions. The controller 12, shown in FIG. 1 may be configured to send control signals to the control valve to trigger a cam timing adjustment and therefore is electronically coupled to the control valve.

The locked configuration may include when a locking pin 802, shown in FIG. 8B, is inserted into a locking pin recess 806, shown in FIG. 8B. The locking functionality of the phase control apparatus 300 is discussed in greater detail herein.

Continuing with FIG. 6, the vane 604 is rotated away from the housing 310 when the phase control apparatus 300 is locked. Specifically, the vane may be spaced away from the housing across a full range of locked positions. For instance, the vane may be spaced away from the housing when the locking pin is contacting the locking pin recess on an advanced side of the recess or on a retarded side of the recess or at any position therebetween. The vane 604 may be spaced away from the housing 310 in a circumferential direction. In one example, the housing 310 is rotated away from the vane 604 by ≥0.1°. Thus, the housing may be spaced away from the vane.

Specifically, a surface 608 of the vane 604 is rotated away (e.g., rotated away in a circumferential direction) from a surface 606 of the housing 310 forming a gap 609. Particularly in one example, the surface 606 may be spaced away from the surface 608 by ≥1°. When the vane 604 is spaced away from the housing 310 in the locked configuration (e.g., across the full range of locked positions) the likelihood of the vane 604 striking the housing 310 caused by tolerances and backlash in the locking mechanism is substantially reduced (e.g., eliminated). Consequently, NVH within the phase control apparatus 300 is substantially reduced, thereby increasing customer satisfaction and component longevity.

The surfaces 606 and 608 are correspondingly contoured in the depicted example. Specifically, the surfaces 606 and 608 are planar in the depicted example and therefore may be referred to as planar surfaces. However, other surface contours have been contemplated. The surface 606 of the housing 310 may correspond to a retarded cam timing position (e.g., fully retarded cam timing position). Therefore, when the vane 604 is in face sharing contact with the surface 606 the phase control apparatus 300 may be in a retarded cam timing position. Likewise, a second surface 610 of the housing 310 may correspond to an advanced cam timing position. Thus, when the second surface 610 of the housing 310 is in face sharing contact with a second surface 612 of the vane 604 the phase control apparatus 300 may be in an advanced cam timing position (e.g., fully advanced cam timing position). In this way, the housing 310 may define the advanced and retarded valve timing boundaries of the VCT system.

The second vane 605 and the third vane 607 are also spaced away from the housing 310 when the phase control apparatus 300 is in the locked configuration, reducing the likelihood of the second and third vanes striking the housing.

FIG. 7 shows another cross-sectional view of the phase control apparatus 300. A valve spool 700 is shown in FIG. 7. The valve spool 700 is configured to direct hydraulic fluid (e.g., oil) to certain portions of the phase control apparatus 300 for phase adjustment. The inner plate 312 and the outer plate 314 are also shown in FIG. 7. The drive wheel 302 is also shown in FIG. 7. Additionally, the cover plate 308 and the housing 310 are also shown in FIG. 7.

FIG. 8A shows another cross-sectional view of the phase control apparatus 300. The valve spool 700, vane rotor 600, housing 310 and cover plate 308 are also shown in FIG. 8A. As previously discussed, the cover plate 308 is coupled to the housing 310. A locking mechanism 800 is also shown in FIG. 8A. The locking mechanism 800 may be one of the locking mechanisms 222 and 224 shown in FIG. 2. The locking mechanism 800 may be adjustable in a locked configuration in which the relative position of vane rotor 600 and the cover plate 308 and housing 310 are substantially fixed. FIG. 8A shows the locking mechanism 800 in a locked configuration. It will be appreciated that due to the tolerances in the locking mechanism 800 there may be small adjustments in the position between the vane rotor 600 and the cover plate 308 and housing 310 when the locking mechanism is in a locked configuration. Therefore, the vane 604, shown in FIG. 6, is circumferentially spaced away from the housing 310 to reduce the likelihood of (e.g., prevent) the vane 604 striking the housing 310 when the locking mechanism 800 is in a locked configuration. In this way, NVH with the VCT system is reduced thereby increasing customer satisfaction and component longevity.

An expanded view of the locking mechanism 800 is shown in FIG. 8B. The housing 310, cover plate 308, and vane rotor 600 are shown in the expanded view. A locking pin 802 included in the locking mechanism 800 is included in or coupled to the vane rotor 600. A spring 804 included in the locking mechanism 800 is coupled to the locking pin 802. Specifically, the spring 804 extends into the locking pin 802. However, in other examples, the spring 804 may be coupled to an exterior surface of the locking pin 802. The spring 804 may be fixedly coupled to a portion of the vane rotor 600. The spring 804 is configured to exert an axial force on the locking pin 802. In this way, the locking pin 802 may return to a locked position when hydraulic pressure or other actuating force exerted on the locking pin is discontinued. However, other actuation techniques have been contemplated. The locking pin 802 is positioned in a locking pin recess 806 including in the locking mechanism 800 in the locked configuration of the locking mechanism. On the other hand, in an unlocked configuration the locking pin 802 is moved in an axial direction such that the locking pin 802 is positioned external to the locking pin recess 806. In the unlocked configuration the relative position of the van rotor 600 and the housing 310 may be hydraulically adjusted by a control valve (e.g., hydraulic control valve) included in the phase control apparatus 300, for example.

Hydraulic fluid (e.g., oil) may be used to actuate the locking mechanism 800 in an unlocked position. Specifically, hydraulic fluid may be directed into cavity 806 to urge the locking pin 802 into the unlocked position.

FIG. 9 shows a cross-sectional view of the locking pin 802 and the locking pin recess 806 in a locked configuration where the locking pin is positioned in the locking pin recess. As shown, the locking pin 802 is spaced away (e.g., circumferentially spaced away) from a portion of the locking pin recess 806 forming a gap 902. It will be appreciated that the locking pin 802 may move in an axial direction during locking and unlocking. In the view shown in FIG. 9 the axial direction extends into and out of the page. Controller 12, shown in FIG. 1, is configured to trigger adjustment of the locking mechanism 800.

As shown, the locking pin 802 is in contact with a retard side 840 of the locking pin recess 806. An advance side 842 of the locking pin recess 806 is also shown. It will be appreciated that when the locking mechanism 800 is positioned in this way the gap 609 between the vane 604 and the housing 310 is present. Additionally, when the locking pin 802 is in contact with the advanced side 842 of the locking pin recess 806 a gap between the vane and the housing is also present. Therefore, across the full backlash range between the locking pin and the locking pin recess the vane may be circumferentially spaced away from the housing.

In the depicted example, the separation between the locking pin 802 and the locking pin recess 806 is on an advance side of the locking pin. On the other hand the separation between the vane 604, shown in FIG. 6 and the housing 310, shown in FIG. 6 is on a retard side of the vane. Therefore, the locking pin 802 may contact the locking pin recess 806 when rotated in both an advance timing direction and retard timing direction. In this way, the likelihood of the housing striking the vane is substantially reduced (e.g., eliminated) to reduce NVH in the phase control apparatus. It will be appreciated that in other examples, the separation between the locking pin and the locking pin recess is on a retarded side of the locking pin.

Continuing with FIG. 9, the locking pin 802 is cylindrical. Therefore, in such an example the locking pin may be referred to as a cylindrical locking pin. Additionally, the locking pin recess 806 is also cylindrical. Therefore in such an example the locking pin recess may be referred to as a cylindrical locking pin recess. The cylindrical locking pin 802 has a diameter that is less than the diameter of the cylindrical locking pin recess 806. Furthermore, it will be appreciated that the diameter of the cylindrical locking pin may not vary along its length. Likewise, the diameter of the cylindrical locking pin recess may not vary along its length.

As show, the locking pin and locking pin recess have a backlash 900 in the locked configuration. Thus, only a portion of the locking pin 802 is in face sharing contact with the locking pin recess 806 when locked in the locking pin recess. In one example, the backlash 900 may be ≥0.1° and ≤0.3°. In another example, the backlash 900 may be ≥0.3° and ≤0.9°. Having this amount of backlash enables the manufacturing cost of the locking pin and locking pin recess to be reduced due to the lower cost of manufacturing components with larger tolerances.

FIG. 10 shows a method 1000 for operation of a VCT system. Method 1000 may be used to control the VCT system discussed above with regard to FIGS. 1-9 or may be used to control another suitable VCT system.

At 1002 the method includes actuatably positioning a locking pin in a locking pin recess, the locking pin extending from a vane rotor in the VCT system and the locking pin recess included in a cover plate coupled to a housing in the VCT system, the housing spaced away from a vane in the vane rotor across a full range of all locked pin positions.

At 1004 the method includes actuatably removing the locking pin from the locking pin recess. Next at 1006 the method includes hydraulically adjusting the relative position of the vane rotor and housing based on the engine operating conditions. Hydraulically adjusting the relative position of the vane rotor and the housing includes at 1008 positioning the vane rotor in an advanced or retarded position where the vane is in face sharing contact with the housing.

In one example, actuatably positioning the locking pin in a locking pin recess in implemented when engine oil pressure is below a threshold value and actuatably removing the locking pin from the locking pin recess and hydraulically adjusting the relative position of the vane rotor and housing are implemented when the engine oil pressure is above a threshold value.

Further in one example the locking pin and locking pin recess have a backlash. Additionally, the housing may at least partially surrounds the vane in one example. In one further example, the locking pin may move in an axial direction during actuatably positioning.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein. The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operation of a variable cam timing (VCT) system, comprising:

actuatably positioning a locking pin in a locking pin recess, the locking pin extending from a vane rotor in the VCT system and the locking pin recess included in a cover plate coupled to a VCT system housing, the VCT system housing spaced away from and not directly contacting a vane in the vane rotor across a full range of all locked pin positions.

2. The method of claim 1, further comprising actuatably removing the locking pin from the locking pin recess and hydraulically adjusting a relative position of the vane rotor and housing based on engine operating conditions.

3. The method of claim 2, where hydraulically adjusting the relative position of the vane rotor and the VCT system housing includes positioning the vane rotor in an advanced or retarded position where the vane is in face sharing contact with the housing.

4. The method of claim 2, where actuatably positioning the locking pin in a locking pin recess is implemented when engine oil pressure is below a threshold value and actuatably removing the locking pin from the locking pin recess and hydraulically adjusting the relative position of the vane rotor and the VCT system housing are implemented when the engine oil pressure is above the threshold value.

5. The method of claim 1, where the locking pin and locking pin recess have a backlash.

6. The method of claim 5, where the backlash is less than the spacing away of the VCT system housing from the vane.

7. The method of claim 1, where the housing at least partially surrounds a vane.

8. The method of claim 1, where the locking pin moves in an axial direction during actuatable positioning.

9. The method of claim 1, wherein the vane is spaced away from the VCT system housing in a circumferential direction.

10. The method of claim 9, where a planar surface of the VCT system housing is spaced away from a planar surface of the vane in the circumferential direction.

11. The method of claim 1, where the VCT system housing defines advanced and retarded valve timing boundaries of the VCT system.

12. The method of claim 1, where only a portion of the locking pin is in face sharing contact with the locking pin recess when locked in the locking pin recess.

13. The method of claim 1, where the cover plate is fixedly coupled to the VCT system housing.

14. The method of claim 1, where the vane is included in a vane rotor having a second vane, where the second vane is spaced away from the VCT system housing.

15. The method of claim 1, further comprising flowing hydraulic fluid between the VCT system housing and the vane across a full range of all locked pin positions.

* * * * *